US006528182B1

(12) United States Patent
Bello et al.

(10) Patent No.: US 6,528,182 B1
(45) Date of Patent: Mar. 4, 2003

(54) ZINC COATED STEEL PLATES COATED WITH A PRE-LUBRICATING HYDROXYSULPHATE LAYER AND METHODS FOR OBTAINING SAME

(75) Inventors: Alain Bello, Hettange-Grande (FR); Sylviane Wajda, Hayange (FR); Jacques Petitjean, Thionville (FR); Armand Rossi, Fameck (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/786,984

(22) PCT Filed: Sep. 15, 1998

(86) PCT No.: PCT/FR99/02141

§ 371 (c)(1),
(2), (4) Date: Jun. 25, 2001

(87) PCT Pub. No.: WO00/15878

PCT Pub. Date: Mar. 23, 2000

(30) Foreign Application Priority Data

Sep. 15, 1998 (FR) ..... 98 11441

(51) Int. Cl.[7] ..... B32B 15/04; C23C 22/53; C25D 11/34

(52) U.S. Cl. ..... 428/628; 72/39; 72/41; 72/42; 148/246; 148/270; 205/316; 205/477; 205/496; 205/508; 423/544; 428/659; 428/469; 428/688; 428/689; 428/702; 428/908.8

(58) Field of Search ..... 428/628, 659, 428/469, 688, 689, 702, 908.8; 205/316, 496, 508, 477; 423/544; 72/39, 41, 42

(56) References Cited

U.S. PATENT DOCUMENTS 4,935,111 A * 6/1990 Suzuki et al. ..... 205/316
5,367,903 A * 11/1994 Keller ..... 72/42

FOREIGN PATENT DOCUMENTS

EP 0339578 A1 * 11/1989
JP 61-060915 A * 3/1986
JP 63-274797 A * 11/1988

OTHER PUBLICATIONS

Abd El Rehim et al, "The Influence of some Sulfur–Containing Anions on the Anodic Behavior of Zinc in an Alkaline Medium", *J. Electroanal. Chem., 401(1–2)*:113–118 (1996), Chemical Abstract, 124(16): Abstract No. 214352 (1996) (no month given).

* cited by examiner

*Primary Examiner*—Robert R. Koehler
(74) *Attorney, Agent, or Firm*—Sughrue Mion, PLLC

(57) ABSTRACT

The invention concerns a steel plate coated with a metal layer based on zinc and a zinc hydroxysulphate layer, whereof the surface density of sulphur is more than 0.5 mg/m$^2$. The invention also concerns a method for obtaining said plate by treating a zinc coated sheet metal: either in a highly alkaline sulphate solution under polarization; or in a sulphate solution containing $Zn^{2+}$ ions without polarization. The hydroxysulphate deposit brings about a pre-lubricating effect applicable to operations for forming sheet metal.

18 Claims, 3 Drawing Sheets

ZINC COATED STEEL PLATES COATED WITH A PRE-LUBRICATING HYDROXYSULPHATE LAYER AND METHODS FOR OBTAINING SAME

The invention concerns the pre-lubrication of the zinc coated surface of plates coated with zinc or zinc-based alloy and the treatment of these plates in aqueous solutions containing sulphates.

The document entitled "The influence of some sulphur-containing anions on the anodic behaviour of zinc in an alkaline medium", written by S. S. Abd El Rehim et al., published in "Journal of Electroanalytical Chemistry", 401 (1996) 113–118, describes, in an alkaline medium (|NaOH|= 0.1 M, therefore pH=13), the oxidation of zinc into zinc hydroxide $Zn(OH)_4^=$ ion in a first step, then the oxidation of this hydroxide ion into zinc oxide $ZnO_2$ in a second step; this document also describes the influence of sulphur-containing species in solution, in particular of sulphate $SO_4^=$ ions, on the second oxidation step.

According to this document, if the concentration of $Zn(OH)_4^=$ ions attains the product of solubility, the zinc hydroxide $Zn(OH)_2$ precipitates and forms a passivating film on the surface.

Figure 2:
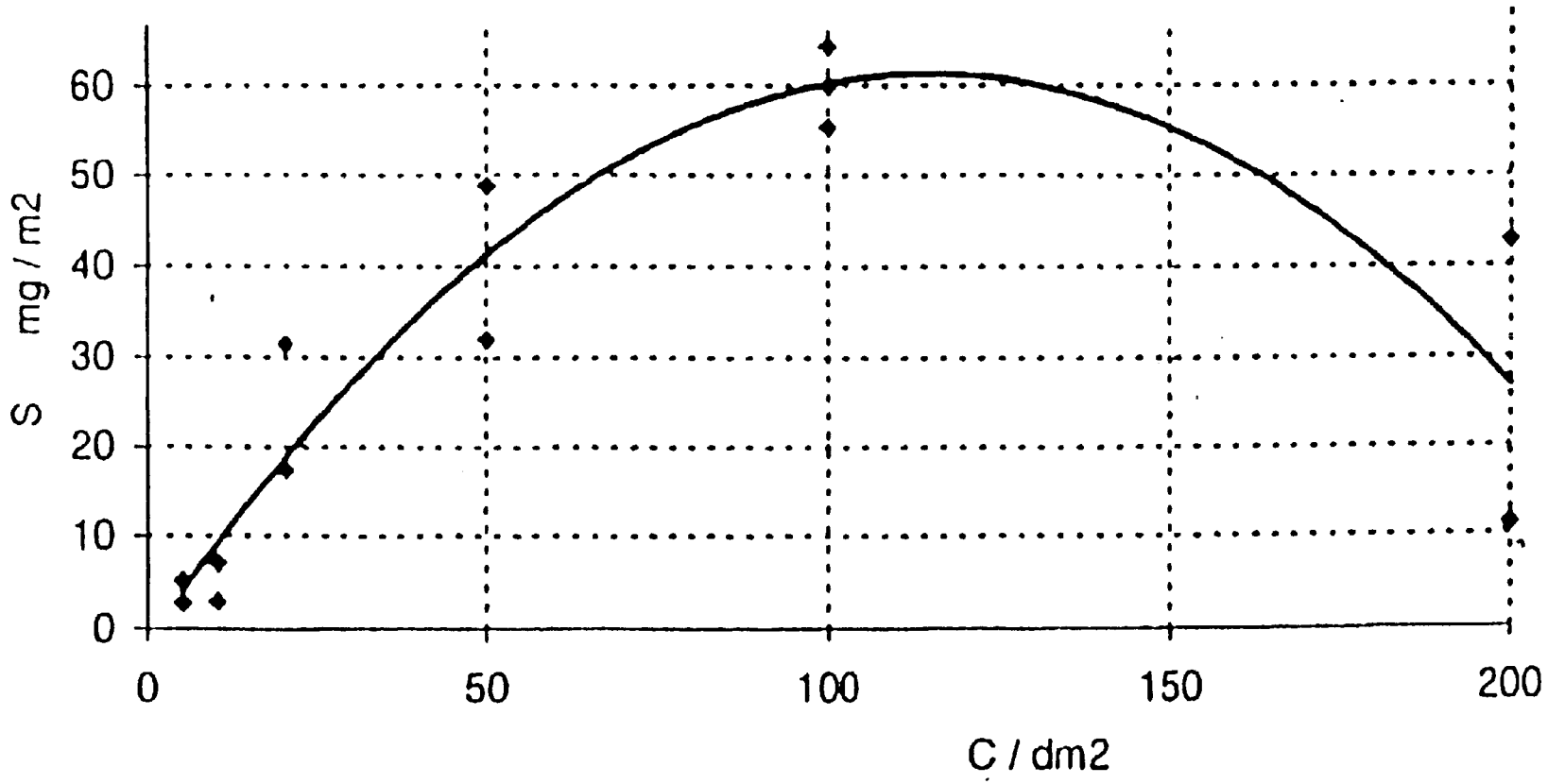
Figure 4:
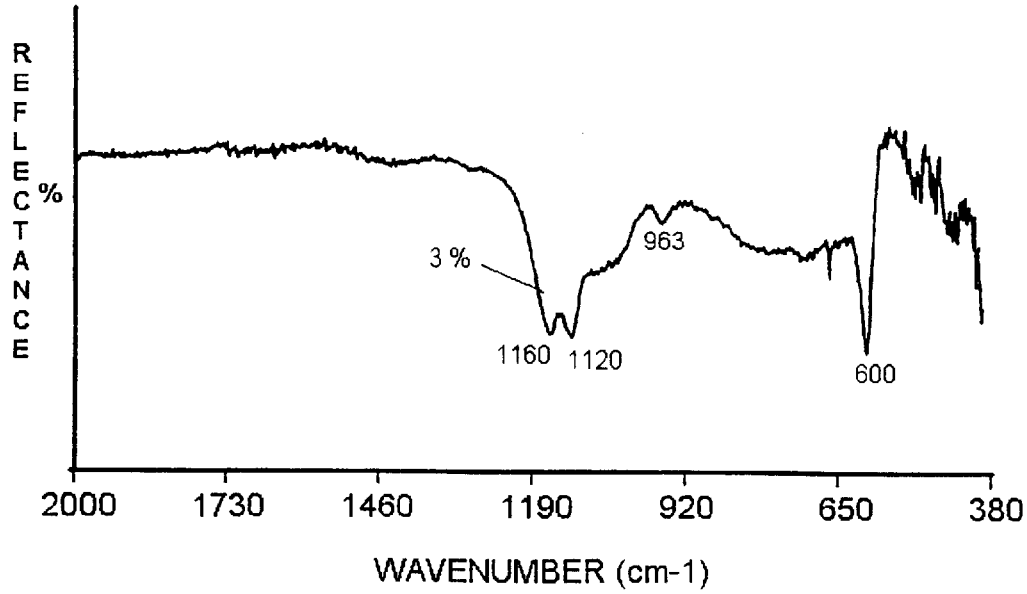

With reference to FIGS. 2 and 4, this document (cf. page 115) teaches that the presence of $SO_4^=$ anions stimulates the dissolution of the zinc; this effect might come from the adsorption of these anions on the zinc-coated surface which facilitates oxidation of the zinc of this surface by these adsorbed anions.

With reference to FIGS. 2 and 5, this document (cf. page 115) also teaches that too high a concentration of anions in the alkaline solution provokes rupture of the passivation film formed after the first oxidation step.

The domain of concentration studied in this document covers the range 0.05 to 1.7 mole $SO_4^=$ per liter.

Documents JP 61-60915, 63-46158, 63-46159 and EP 0 339 578 describe anodic treatments of zinc-coated steel plates in aqueous solutions containing sulphates and the use of these treatments to colour the zinc-coated surfaces of these plates.

The concentration of electrolyte in the treatment solution is included between 70 and 200 g/l; the concentration of sodium sulphate is for example 150 g/l, i.e. about 1 mole/liter.

Document JP 63-274797 describes the use of a treatment of the same type for improving the aptitude to phosphatisation of steel plates coated by electrodeposit of a zinc-based alloy containing nickel.

The treatment solution then contains, in addition to sulphates (for example: magnesium, sodium or aluminium sulphate at 150 g/l), carboxylic acids (for example citric, maleic, salicylic at 30 or 40 g/l).

The pH of the treatment solution is included between 4 and 5.5.

The anodic treatment is conducted under a current density included between 30 and 200 $A/dm^2$ until the quantity of electricity consumed is included between 50 and 500 $C/dm^2$ of surface to be treated.

According to this document, this treatment improves the aptitude to phosphatisation because it results in the elimination of the superficial traces of zinc hydroxides —$Zn(OH)_2$— and makes it possible to improve the surface reactivity.

The plates resulting from these treatments under anodic polarisation in aqueous solutions containing at least 0.05 mole of sulphate ions per liter, particularly more than 10 g/l of sulphate ions, pose problems in deep-drawing and forming.

Patent EP 0 489 105 describes a method of treating the metallic surface of a plate, particularly a steel plate, intended for preparing said plate for deep-drawing and/or for protecting it against corrosion, in which:

- there is applied on this surface an aqueous solution of a water-soluble salt of an alkaline metal, particularly potassium phosphate,
- said surface is dried,
- then at least one operation of oiling of said surface is carried out.

The conditions of application and of drying are adapted in order to obtain a deposit of phosphate of surface density included between 5 to 40 $mg/m^2$.

The oil used may be an oil for temporary protection against corrosion and/or a lubricating oil for forming, particularly deep-drawing.

Thus, before storage and/or transport, a first oiling for protection may be effected; after taking from stock, a second oiling for lubrication may be effected, for preparing forming, particularly by deep-drawing.

According to this document EP 0 489 105, the phosphatisation treatment, prior to oiling, makes it possible substantially to improve lubrication at the moment of forming: it is therefore question of a pre-lubrication treatment.

The zinc-coated plate obtained is provided with a pre-lubricating deposit based on phosphate.

The lubricating effect of this phosphatisation treatment sometimes proves to be insufficient on zinc-coated plates; furthermore, this treatment generates effluents containing phosphates, which it is desired to avoid.

The invention has for an object to provide a pre-lubricated zinc-coated plate with higher performances than those obtained by phosphatisation and to offer a treatment of pre-lubrication of zinc-coated plates more efficient than a treatment of phosphatisation and more respectful of the environment at the level of the effluents that it generates.

To that end, the invention has for its object a steel plate coated with a metal layer based on zinc, characterized in that:

- said metal layer is itself coated with a layer based on zinc hydroxysulphate,
- the surface density of sulphur corresponding to said layer of hydroxysulphate is more than 0.5 $mg/m^2$.

Other advantageous characteristics of the plate according to the invention are indicated in the dependent Claims.

Several methods of hydroxysulphation make it possible to arrive at the pre-lubricated zinc-coated plate according to the invention.

The invention therefore also has for an object a first method of obtaining a plate according to the invention from a steel plate coated with a metal layer based on zinc comprising the steps consisting in applying on the zinc-coated surface of the starting plate an aqueous treatment solution containing more than 0.07 moles of sulphate ions per liter, in polarising in anodic manner said surface so as to cause a polarisation current to circulate, then rinsing said surface, then drying it, characterized in that

- the pH of said solution is greater than or equal to 12 and less than 13,
- the quantity of electric charges, circulating during the treatment through said surface and generating on said surface the deposit of a layer including sulphur, is adapted so that the quantity of sulphur obtained in said layer of hydroxysulphate exceeds 0.5 $mg/m^2$.

Other advantageous characteristics of the first method of obtaining the plate according to the invention are indicated in the dependent Claims.

In practice, it is possible to determine, for predetermined conditions of use of the treatment solution, the minimum quantity of charges that should be circulated in order to obtain a deposit presenting a sulphur content of 0.5 mg/m$^2$, to carry out this method, the quantity of charges used must in that case be greater than this minimum quantity.

The plate obtained by this method, then oiled, offers very good tribological properties well adapted to forming, particularly by deep-drawing: this hydroxysulphation treatment therefore has an effect of pre-lubrication.

By optimalizing the thickness of the layer of hydroxysulphate deposited, the pre-lubricating effect obtained is greater than that contributed by a treatment in a solution of phosphate as described in EP 0 489 105.

Figure 3:
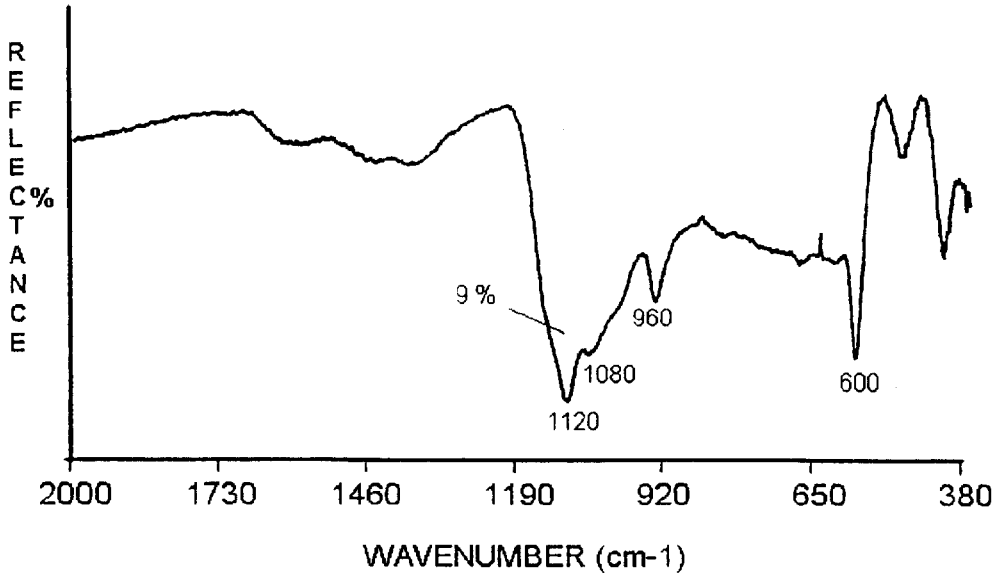

It is observed that this effect of pre-lubrication comes from the nature of the deposit: the infrared reflection spectrum of the deposit obtained is shown in FIG. 3 (reflectance in % as a function of the wave number in cm$^{-1}$); here it is essentially a question of a layer of zinc hydroxysulphate, also called basic zinc sulphate; this hydroxysulphate would correspond to the general formula:

$$[Zn_x(SO_4)_y(OH)_z, tH_2O],$$

where 2x=2y+z, with y and z different from zero; preferably, z is higher than or equal to 6, and more preferably z=6 and $3 \leqq t \leqq 5$; according to the spectrum of FIG. 3, x=4, y=1, z=6 and t=5.

In order to be efficient at the level of pre-lubrication, this layer of zinc hydroxysulphate should adhere to the surface treated: the conditions relating to the pH of the treatment solution and the step of drying at the end of treatment are decisive to that end.

If the pH of the solution is less than 12, no hydroxysulphates adherent on the surface to be treated are formed; if the pH of the solution is greater than or equal to 13, the hydroxysulphate re-dissolves and/or decomposes into zinc hydroxides; in that case, we are again under conditions similar to those described in the document of S. S. Abd El Rehim cited hereinabove.

After rinsing but before drying, the layer deposited on the plate presents the appearance of a gel which is still only sparingly adherent; drying is adapted in order to eliminate the residual liquid water from the deposit and enables the layer to adhere better on the plate.

When sodium sulphate is used in the solution, if the concentration of sodium sulphate is less than 10 g/l in the solution, hardly any formation of layer of hydroxysulphate on the surface is observed; more generally, it is therefore important that the concentration of sulphate ions be greater than 0.07 moles per liter.

Preferably, the concentration of sulphate ions is less than or equal to 1 mole/liter; in the case of using sodium sulphate, at concentrations greater than 142 g/l (equivalent to 1 mole $SO_4^=$/liter), for example 180 g/l, a reduction is observed in the yield of formation of the layer of hydroxysulphate.

It was observed that the pre-lubricating effect of the treatment was obtained only if the thickness of the layer deposited corresponded to more than 0.5 mg/m$^2$ in sulphur equivalent, preferably at least 3.5 mg/m$^2$ in sulphur equivalent.

Inversely, it was observed that the pre-lubricating effect of the hydroxysulphate layer decreased if the quantity of sulphur deposited largely exceeded 30 mg/m$^2$, apparently due to the degradation of the adherence of this layer; it was also observed that, if the quantity of sulphur deposited exceeded 27 mg/m$^2$, the phosphatisability of the plate obtained degraded, the crystals of phosphate deposited in that case being too large.

Thus, in order to obtain a significant pre-lubricating effect, the quantity of hydroxysulphates deposited must be greater than 0.5 mg/m$^2$ and less than or equal to 30 mg/m$^2$ in sulphur equivalent, preferably included between 3.5 and 27 mg/m$^2$ in sulphur equivalent.

The charge density applied must therefore be adapted to this quantity of hydroxysulphates adapted to procure this significant pre-lubricating effect.

Preferably, the charge density applied is thus preferably included between 10 and 100 C/dm$^2$ of surface to be treated.

If the charge density exceeds 100 C/dm$^2$, it is observed that the quantity of sulphur deposited on the surface no longer increases and even decreases.

This first method of obtaining a plate according to the invention therefore makes it possible to form on a zinc-coated surface a layer based on hydroxysulphate, which is both sufficiently thick and adherent.

Thanks to the anodic polarisation of the zinc-coated surface to be treated, the zinc dissolves rapidly in the immediate proximity of the zinc-coated surface, this promoting precipitation of zinc salts on this surface.

Thus, in order to effect this treatment as productively as possible with a satisfactory faradic output, the deposit of the hydroxysulphate layer should be effected under a current density of high polarisation, particularly higher than 20 A/dm$^2$.

For a current density less than or equal to 20 A/dm$^2$, the yield of deposit is very low and the sulphur content of the layer deposited does not enable the optimum pre-lubricating effect to be obtained.

Experimental tests have shown that, for a predetermined electric charge density, for example 20 C/dm$^2$, the quantity of sulphur deposited on the surface to be treated was an increasing homogeneous function of the current density in the range of values included between 20 and 200 A/dm$^2$; preferably, a current density which is as high as possible will therefore be chosen, for example 200 A/dm$^2$.

As counter-electrode, a cathode made of titanium may be used.

The temperature of the treatment solution is generally included between 20° C. and 60° C.; preferably, one proceeds at a temperature higher than or equal to 40° C., so as to increase the conductivity of the solution and to reduce the ohmic losses.

The speed of circulation of the solution on the surface of the plate does not, here, have any decisive influence on the treatment according to the invention.

After formation of the layer of hydroxysulphate on the surface, the treated surface is rinsed abundantly with demineralized water; within the framework of this first method, the step of rinsing is important to eliminate the alkaline reagents on the surface of the deposit, which would cause problems of corrosion.

The plate thus pre-lubricated by the treatment according to the invention presents a homogeneous coloration, a little stronger with respect to that of a non-treated zinc-coated plate; nevertheless, this treatment does not colour the plate, as in documents JP 61-60915, 63-46158, 63-46159 and EP 0 339 578 already cited; observed under a microscope, the deposit resulting from the treatment according to the invention is in the form of scattered plates; it has been noted that the density of plates increased with the quantity of sulphur deposited per surface unit.

In this first method of obtaining a pre-lubricated zinc-coated plate according to the invention, the zinc necessary for the formation of the pre-lubricating deposit of zinc hydroxysulphate comes from the anodic dissolution of the zinc under the effect of the polarisation of the zinc-coated surface.

This first method of obtaining obviously presents the economic disadvantage of requiring a polarisation installation.

In order to overcome this drawback, the invention also has for an object a second method of obtaining a plate according to the invention from a steel plate coated with a metal layer based on zinc comprising:

a step of application, on the zinc-coated surface of the starting plate, of an aqueous treatment solution containing more than 0.01 mole of sulphate $SO_4^{=}$ ions per liter, and a subsequent step of drying, characterized in that:

said treatment solution contains $Zn^{2+}$ ions at a concentration greater than 0.01 mole/liter, the conditions of application, in particular the duration, the temperature of said solution, the concentration of $SO_4^{=}$ ions and of $Zn^{2+}$ ions in said solution, are adapted so that the quantity of sulphur obtained in said layer of hydroxysulphate exceeds 0.5 mg/m$^2$.

Other advantageous characteristics of the second method of obtaining the plate according to the invention are indicated in the dependent Claims.

This second method of obtaining a plate according to the invention does not require a polarisation installation.

For example, the treatment solutions are prepared by dissolution of zinc sulphate in pure water; for example heptahydrated zinc sulphate ($ZnSO_4$, 7 $H_2O$) is used; the concentration of $Zn^{2+}$ ions is in that case equal to that of the $SO_4^{=}$anions.

The pH of the treatment solution used for this second method is generally much less basic than that of the treatment solution used for the first method; the pH of the treatment solution preferably corresponds to the natural pH of the solution, without addition of base nor of acid; the value of this pH is generally included between 5 and 7.

The treatment solution is applied on a zinc-coated surface of plate in conventional manner, for example by immersion, by spraying or by coating.

The conditions of application, such as the duration for immersion and spraying or the quantity for coating, such as the temperature of solution, such as the concentrations of $SO_4^{=}$ and $Zn^{2+}$ ions, are adapted in manner known per se for the quantity of sulphur obtained in the final layer of hydroxysulphate to exceed 0.5 mg/m$^2$.

It has been observed that, if the concentration of $SO_4^{=}$ ions and/or if the concentration of $Zn^{2+}$ ions were less than 0.01 mole per liter, such a layer of hydroxysulphate would not be able to be formed.

The treatment solutions used preferably contain between 20 and 160 g/l of heptahydrated zinc sulphate, corresponding to a molar concentration of $Zn^{2+}$ or $SO_4^{=}$ions included between 0.07 and 0.55 mole/liter; in this range of concentrations, it has been observed that the speed of deposit was little influenced by the value of the concentration.

After application and before drying, the layer deposited on the plate is adherent; drying is adapted to eliminate the residual liquid water from the deposit.

Between the step of application and the step of drying, the plate is preferably rinsed so as to eliminate the soluble part of the deposit obtained; the absence of rinsing and the obtaining of a deposit partially dissolvable in water which results are not very detrimental to the pre-lubricating effect, as long as the deposit obtained indeed comprises the pre-lubricating layer of hydroxysulphate insoluble in water on contact with the plate.

The plate obtained by this second method presents intrinsic and extrinsic characteristics comparable to those of the plate obtained by the first method; the infrared reflexion spectrum of the deposit of hydroxysulphate under glancing incidence is given in FIG. 4 (reflectance in % as a function of the wave number in cm$^{-1}$); here it is also essentially a question of a layer of zinc hydroxysulphate which would correspond to the general formula:

$$[Zn_x(SO_4)_y(OH)_z, tH_2O],$$

where 2x=2y+z, with y and z different from zero; z is preferably higher than or equal to 6; and more preferably z=6 and $3 \leqq t \leqq 5$, according to the spectrum of FIG. 4, x=4, y=1, z=6 and t=3; the deposit of hydroxysulphate obtained is finely crystallized and highly covering.

This second method presents the following advantages over the first method:

the anodic polarisation of the zinc-coated surface is not necessary in order to obtain the desired pre-lubricating effect, the deposit of hydroxysulphate obtained is more homogeneous.

Numerous parameters may have a significant influence on the speed and/or the thickness of the deposit of hydroxysulphate obtained:

the conditions of applications of the solution:

the duration of application: the deposit obtained after 300 seconds may present a surface density double that obtained after 100 seconds;

the renewal of the solution in the vicinity of the zinc-coated surface: in the case of application in immersion, appropriate stirring of the bath makes it possible to double the speed of deposit;

the temperature of the treatment solution: the range of optimal temperatures is determined, for example between 40° C. and 60° C.

Concerning the incidence of the concentrations of $SO_4^{=}$ ions and $Zn^{2+}$ ions in the treatment solution, it is observed that there exist thresholds of concentration below which no pre-lubricating deposit is obtained, but it is also observed that too high concentrations do not substantially improve the speed of deposit and can even reduce it slightly.

In order to carry out this second method, these parameters are optimalized in manner known per se in order to obtain a deposit of hydroxysulphate according to the invention, i.e. containing a quantity of sulphur greater than 0.5 mg/m$^2$.

According to a variant of this second method, the treatment solution contains an agent oxidising zinc, such as hydrogen peroxide; this oxidising agent may have a very marked hydroxysulphation accelerator effect at low concentration; it has been observed that the addition of only 0.03%, viz 8 $10^{-3}$ mole/liter of hydrogen peroxide, or of 2 $10^{-4}$ mole/liter of potassium permanganate in the solution made it possible to double (approximately) the speed of deposit; on the contrary, it has been observed that concentrations 100 times greater no longer made it possible to obtain this improvement of the speed of deposit.

Taking into account the pre-lubricating effect of the deposit of hydroxysulphate, the invention finally has for an object a method for forming a steel plate coated with a metal layer based on zinc comprising the steps consisting in treating the surface of said coated plate according to the first or the second method described hereinabove, in applying a film of lubricating oil on said dried treated surface and in forming said plate proper.

These methods are applied for example on plates zinc-coated by electrolysis; for plates galvanized by immersion, the second method of treatment will preferably be used; for plates coated with zinc alloy, the second method of treatment will for example be used without rinsing.

Figure 1:
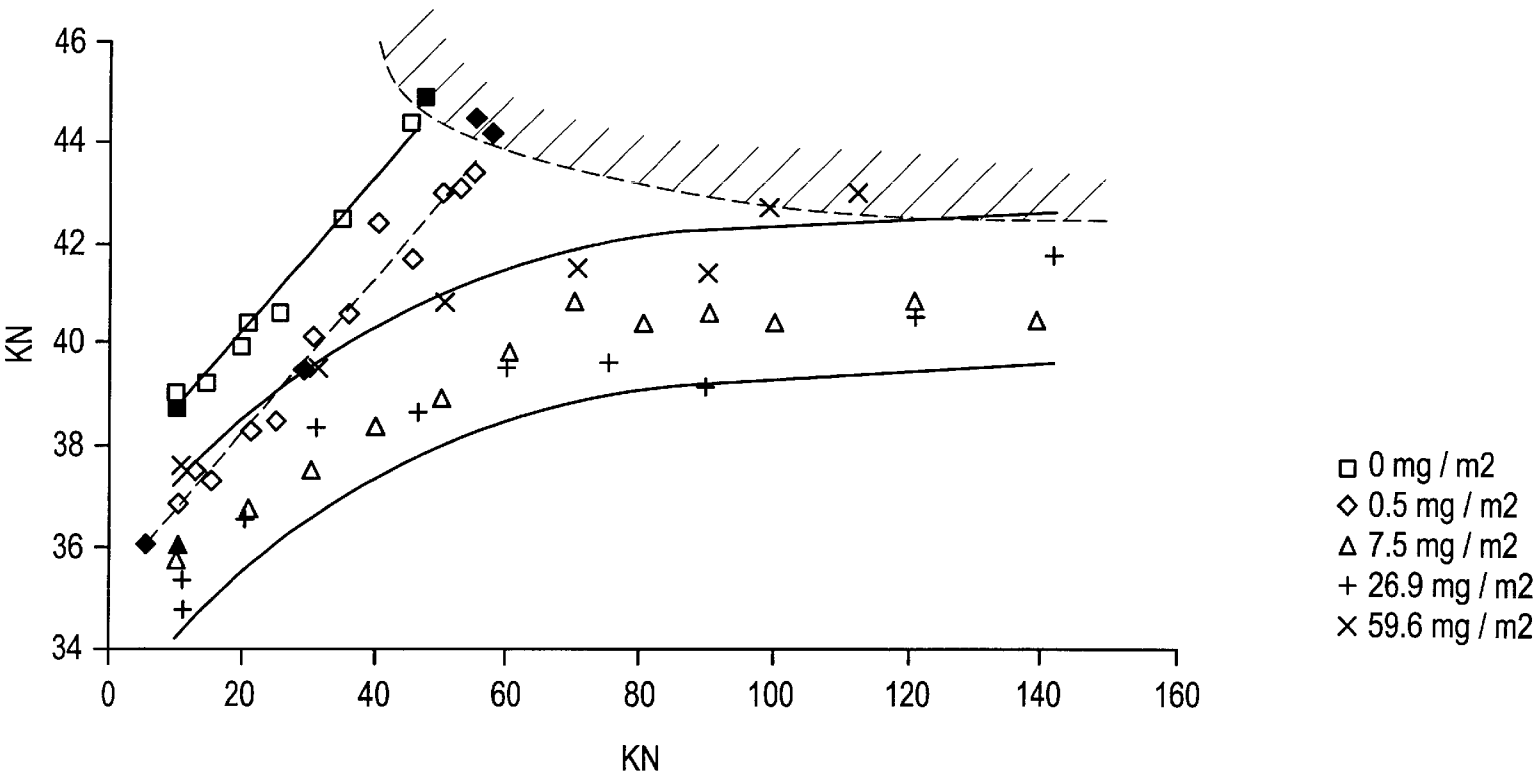

Other advantages of the method and of the zinc-coated plate of the invention will appear on reading the Examples given hereinafter by way of non-limiting example of the present invention and with reference to the following Figures:

FIG. 1, with reference to Example 1, illustrates the results of the deep-drawing property tests made on different samples of plate treated according to the invention or not treated; the hatched zone corresponds to the zone of rupture.

FIG. 2, with reference to Example 4, illustrates the variations of the quantity of sulphur obtained by the first method according to the invention, as a function of the charge density of polarisation applied.

FIGS. 3 and 4 show the infrared reflection spectra of plates coated with a layer of hydroxysulphate according to the invention, respectively according to the first and according to the second methods of obtaining this plate described hereinabove.

MATERIALS

1) The plate used for the treatment tests is a steel plate, grade so-called "aluminium-killed steel" of quality ES, of thickness 0.7 mm, coated by electroplating in a chloride bath on the two faces with a metal layer of zinc of thickness of about 7.5 $\mu$m.
2) The sulphate used for preparing the treatment solution of the first method is sodium sulphate; any other soluble sulphate may be used.

The sulphate used for the second method according to the invention is heptahydrated zinc sulphate $ZnSO_4$, 7 $H_2O$.

METHODS

1) Deep-drawing Property Tests

A drawing press is employed, adapted to make cups with an internal diameter of 50 mm from blanks of plates of diameter 90 mm; a stamp of diameter 50 mm is used, presenting at its end a radius of curvature of 3 mm, a die of diameter 52.6 mm presenting an inner raised edge of radius of curvature 3.5 mm.

The speed of deep-drawing is adjusted to 12 cm/min.; the maximum force of clamping is 150 kN.

The press is equipped with means for continuously monitoring the parameters of deep-drawing, in particular the clamping pressure, the force of deep-drawing and the stroke of the stamp.

During an operation of deep-drawing of a given blank of plate under a predetermined plate clamping pressure, the curve of evolution of the deep-drawing force as a function of the stroke of the stamp is plotted; this curve passes through a maximum which defines the maximum force of deep-drawing during operation.

For a series of deep-drawing operations under different clamping pressures, a series of values of maximum deep-drawing forces is thus obtained; the curve of evolution of the maximum deep-drawing force as a function of the clamping pressure can then be plotted; these curves often correspond to straight lines, of which the slope characterizes the frictions of the stamp and of the die on the two faces of the plate.

A slight slope corresponds to slight frictions, i.e. to plates well lubricated on the two faces.

This deep-drawing test protocol therefore makes it possible to evaluate the level of lubrication of the surface of a plate with a view to its deep-drawing; in order to evaluate this level on one face, a Teflon® film is affixed on the other face (stamp side) so as to obtain on this other face an always constant friction having regard to that which is exerted on the surface to be evaluated.

In order to evaluate the pre-lubricating effect of a surface treatment of the type of that of the invention, this protocol is applied on plates pre-lubricated by prior treatment and oiled in standard manner (with film of Teflon® on the non-treated face); standard oiling consists here in applying on the treated surface oil referenced 6130 of the QUAKER Company so as to obtain a layer of about 1 g/m$^2$.

2) Tests of Phosphatisability

In order to evaluate the phosphatisability, particularly after hydroxysulphation treatment according to the invention, the samples of plate are phosphated in accordance with a predetermined protocol corresponding to the conventional methods carried out in the automobile industry, using a plurality of conventional surface treatment baths adapted to form a layer of zinc, manganese and nickel phosphates; baths marketed to that end by the PARKER or CFPI Companies may be used; one or two alkaline degreasing baths, a refining bath, then a phosphatisation bath are thus generally and successively used, each step is followed by a rinsing with water.

After this treatment in accordance with the predetermined protocol, the quality of the layer of phosphates deposited is evaluated, particularly in terms of morphology and of chemical composition; to that end, scanning electron microscopy and atomic absorption spectroscopy are used.

EXAMPLE 1

Effect of a Deposit of Hydroxsysulphates on the Deep-drawing Property of a Zinc-coated Plate Samples of steel plate as defined in the paragraph MATERIALS are used.

With a view to using the first method of obtaining plate according to the invention, a treatment solution is prepared by dissolution of sodium sulphate in water (concentration: 60 g/l) and addition of sodium hydroxide up to pH=12.7.

The treatment of samples of plates is effected in an "electrolyte circulation cell" where they are immersed in this solution taken to 40° C., and where they are anodically polarised with respect to a titanium cathode; the "electrolyte circulation cell" is adjusted so that the speed of the electrolyte in the vicinity of and along the surface of plate to be treated is 100 m/min.

Four tests (Nos. 1 to 4) of treatments are effected, under the conditions mentioned on Table I: the reference sample ("Ref.") mentioned in this Table has not undergone any particular surface treatment.

After immersion and anodic polarisation, the treated samples are rinsed with demineralized water.

TABLE I

Definition of the treatments for deep-drawing tests

| Test No. | Current density | Charge density | Electrolysis time | Quantity deposited mg/m$^2$ Sulphur | Sodium |
|---|---|---|---|---|---|
| Ref. | | 0 C/dm$^2$ | 0 s. | 0.0 mg/m$^2$ | 5.0 mg/m$^2$ |
| 1 | 200 A/dm$^2$ | 5 C/dm$^2$ | 0.025 s. | 0.5 mg/m$^2$ | 5.5 mg/m$^2$ |
| 2 | 200 A/dm$^2$ | 10 C/dm$^2$ | 0.050 s | 7.5 mg/m$^2$ | 4.8 mg/m$^2$ |
| 3 | 150 A/dm$^2$ | 20 C/dm$^2$ | 0.133 s | 26.9 mg/m$^2$ | 4.8 mg/m$^2$ |
| 4 | 200 A/dm$^2$ | 50 C/dm$^2$ | 0.250 s | 59.6 mg/m$^2$ | 5.8 mg/m$^2$ |

The surface of the samples is then analyzed so as to measure the quantity of sulphur deposited on the surface; the quantity of sodium on the surface is also measured; the results are shown in Table I.

The sulphur is dosed by X-ray fluorescence ("SFX"); the depth taken into account by this method of analysis is several microns; as the zinc-coated steel substrate does not contain sulphur (apart from the quantities corresponding to the inevitable impurities), the signal given by this method of dosage then effectively corresponds to sulphur deposited during the treatment; the quantity of sulphur deposited is calculated from the signal measured, in accordance with a pre-established law.

The sodium is dosed, after leaching of the surface with boiling water, by atomic absorption spectroscopy ("AAS").

The quantity of sodium observed on the surface of the reference sample is quite conventional for a steel zinc-coated by electrolysis: the approximately identical quantities found on the treated samples indicate that the sodium of the treatment solution is not incorporated in the deposit based on hydroxysulphate.

One then proceeds with the deep-drawing property tests in the manner described in the paragraph METHODS; the results are shown on a diagram giving on the y-axis the maximum force of deep-drawing in kN and on the x-axis the clamping force in kN; this diagram is shown in FIG. 1 with the following correspondences between the symbols and the samples: reference sample: empty squares (□) or fill ones—test No. 1: empty or full diamonds; test No. 2: triangles (Δ)—tests No. 3: upright crosses (+)—test No. 4: inclined crosses (x); the hatched zone at the top corresponds to the zone of rupture.

A very substantial improvement of the deep-drawing and a very marked pre-lubricating effect are noted as soon as the quantity of sulphur deposited attains 7.5 mg/m$^2$; such a pre-treatment corresponds to a quantity of charges of at least 10 C/dm$^2$ (cf. Table I); the tests of Example 6 show that the pre-lubricating effect is obtained for lower quantities of sulphur, of the order of 3.5 mg/m$^2$.

COMPARATIVE EXAMPLE 1

Demonstration of the Role of the Sulphur on the Pre-lubricating Effect

On the same samples of plate as in Example 1, a comparative treatment is effected under anodic polarisation (charge density: 12 C/dm$^2$—current density: 9.8 A/dm$^2$) in a solution at the same temperature and at the same pH as in Example 1, but not containing sulphates; this comparative treatment therefore consists in depositing a layer of zinc hydroxides in place of the hydroxysulphates of Example 1.

The low level of current density used comes from the low level of conductivity of the electrolyte used which contains only sodium hydroxide.

The same deep-drawing property tests as in Example 1 are effected.

On the diagram (maximum deep-drawing force—clamping force), results are in that case obtained comparable to those of the reference sample and of test No. 1 of Example 1.

Obtaining no pre-lubricating effect with a deposit without sulphur, it is therefore confirmed that a quantity of sulphur greater than 0. 5 mg/m$^2$ in the deposit is necessary for obtaining the desired pre-lubricating effect.

EXAMPLE 2

First Method Under Polarisation: Influence of the Current Density on the Quantity of Sulphur Deposited One proceeds with a series of treatments on the same samples as in Example 1 and with the aid of the same solution as in Example 1.

Unlike Example 1, the treatments are effected in a "rotating electrode cell"; the sample of circular shape is immersed in this cell and is animated by a movement of rotation; the speed of advance of the electrolyte in the vicinity of the sample therefore depends on the speed of rotation.

All the treatments are effected under the same charge density: 20 C/dm$^2$.

Each treatment is effected under a different current density; after treatment, the quantity of sulphur deposited is measured by a method different from that described in Example 1, which uses a Silicon-Lithium ("Si—Li") diode fitted to that end on a scanning microscopy installation.

The results obtained are shown in Table II.

TABLE II

Influence of the current density on the deposit

| Current density (A/dm$^2$) | 25 | 50 | 75 | 100 | 125 | 150 | 175 | 200 |
|---|---|---|---|---|---|---|---|---|
| Quantity Sulphur deposited (mg/m$^2$) | 4.1 | 8.2 | 11.1 | 11.9 | 13.3 | 13.2 | 14.5 | 15.9 |

It is therefore observed that the yield of deposit, expressed in density of sulphur deposited, increases with the current density.

EXAMPLE 3

First Method Under Polarisation: Influence of the pH of the Treatment Solution on the Quantity of Sulphur Deposited One proceeds with a series of treatments on the same samples as in Example 1 and with the aid of a solution similar to that of Example 1, to within the pH value; the treatment installation is the same as in Example 2 ("rotating electrode cell").

All the treatments are carried out under the same charge density 20 C/dm$^2$ and under the same current density 200 A/dm$^2$.

Each treatment is effected with the aid of a solution of different pH; after treatment, the quantity of sulphur deposited is measured by the same method as in Example 2.

The results obtained are shown in Table III.

TABLE III

Influence of the pH of the solution on the deposit

| pH of the solution | 11 | 12 | 12.7 | 13.4 |
|---|---|---|---|---|
| Quantity Sulphur deposited (mg/m$^2$) | 1 | 2 | 13 | 0 |

It is deduced that the quantity of sulphur deposited becomes significant, i.e. greater than 0.5 mg/m$^2$, only if, approximately, $12 \leqq pH < 13$.

EXAMPLE 4

First Method Under Polarisation: Influence of the Charge Density (C/dm$^2$) Applied During the Treatment on the Quantity of Sulphur Deposited One proceeds with a series of treatments on the same samples as in Example 1 and with the aid of the same solution as in Example 1.

All the treatments are effected under the same current density 200 A/dm$^2$, but with different charge densities.

After treatment, the quantity of sulphur deposited is measured by the same method as in Example 1.

The results are shown in FIG. 2 where the sulphur content in mg/m$^2$ has been plotted on the y-axis and the charge density in C/dm$^2$ on the x-axis.

This Figure shows that, beyond a charge density of the order of 100 C/dm$^2$, the quantity of sulphur deposited decreases; such reduction might be explained by the bursting of the first deposits of hydroxysulphates formed under the effect of the continuation of the dissolution of the zinc-coated substrate.

EXAMPLE 5

Effect of the Treatment of Plate According to the Invention on the Phosphatisability One proceeds with the tests of phosphatisability as defined in paragraph METHODS hereinabove, on samples treated according to the invention under the conditions of Example 1, and presenting different surface contents of sulphur (Table I).

After tri-cation (including Mn, Ni) phosphatisation, the microscopic observation of the surface, treated then phosphated, shows that the size of the phosphate crystals deposited increases with the initial surface content of sulphur; such enlargement seems acceptable in the case of the plates resulting from tests No. 2 and No. 3, but seems inacceptable in the case of test No. 4; in order to allow a good phosphatisation, it would be important that the quantity of sulphur deposited resulting from the treatment according to the invention not exceed 27 mg/m$^2$.

Analysis of the phosphated surfaces then reveals that:

- the quantities of manganese and of nickel deposited are indeed correlated to the quantity of phosphorus, which confirms correct phosphatisation;
- the quantity of sulphur is less than 1 mg/m$^2$, which shows that the deposit of hydroxysulphate is eliminated during phosphatisation.

After phosphatisation and painting of plates treated in accordance with tests No. 2 and No. 3 of Example 1, painted plates are obtained, presenting as fine a surface appearance as the reference plate phosphated and painted under the same conditions.

EXAMPLE 6

Carrying Out of the Second Method Without Polarisation by Immersion

With a view to using the second method of obtaining plate according to the invention, a treatment solution is prepared by dissolution of heptahydrated zinc sulphate in water; the solution is used at its natural pH, without addition of acid nor of base; the natural pH obtained is close to 7.

In order to apply the treatment solution, the samples of plates are immersed in this solution, without electrical polarisation.

After immersion, the treated samples are rinsed twice with demineralized water: firstly at 20° C. for about 8 seconds, then at 50° C. for about 5 seconds.

The rinsed samples are then dried.

A deposit of hydroxysulphate is observed on the samples obtained; due to the rinsing, it is therefore considered that the deposits obtained are insoluble in water.

By using a solution with 90 g/l of heptahydrated zinc sulphate, the influence of the conditions of application on the quantity of sulphur contained in the deposit is summarized hereinafter:

- duration of immersion and speed of stirring:
  - without stirring: 5 mg/m$^2$ at 60 s., 10 mg/m$^2$ at 300 s.
  - with stirring: 10 mg/m$^2$ at 60 s., 15 mg/m$^2$ at 120 s., 25 mg/m$^2$ at 300 s.
- temperature of the solution, used with stirring: optimum density of deposit between 42 and 62° C., density of deposit reduced by 30% at about 20° C. or at 70° C.

By using a treatment solution at 50° C. with stirring, it is observed that the concentration of heptahydrated zinc sulphate hardly influences the speed of deposit in the range included between 20 and 160 g/l; the quantity of sulphur obtained in the deposit decreases even when this concentration increases: 5 mg/m$^2$ for 20 g/l, and 3.5 mg/m$^2$ only for 160 g/l after 10 seconds of immersion.

By using a treatment solution at 50° C. with stirring, containing 40 g/l of heptahydrated zinc sulphate and different agents oxidising zinc, the quantity of sulphur obtained in the deposit after 10 seconds of treatment is measured; the results obtained are shown in Table IV and clearly illustrate the interest in using a zinc-oxidising agent at low concentration as agent activating the treatment of hydroxysulphation according to the invention.

TABLE IV

Influence of the zinc-oxidising agent on the speed of deposit

| Activator of hydroxysulphation in the treatment solution: | Hydroxy-sulphate deposit obtained: quantity of sulphur |
|---|---|
| Without (reference) | 4 mg/m$^2$ |
| $CuSO_4$, $5H_2O$ at 0.24 g/l | 5 mg/m$^2$ |
| $H_2O_2$ at 0.03% | 12 mg/m$^2$ |
| $H_2O_2$ at 3% | 8 mg/m$^2$ |
| $KMnO_4$ at 0.001N = 2 $10^{-4}$ mole/liter | 7.5 mg/m$^2$ |
| $KMnO_4$ at 0.1N, viz 2 $10^{-2}$ mole/liter | 2 mg/m$^2$ |

Deep-drawing property tests effected in accordance with the protocol defined in the paragraph "Methods" on samples prepared with the aid of this second method have shown that a pre-lubricating effect comparable to that obtained on samples prepared with the aid of the first method, was obtained; samples presenting a deposit of hydroxysulphate containing respectively 3.5 mg/m$^2$, 4.3 mg/m$^2$ and 6 mg/m$^2$ of sulphur made it possible to obtain maximum deep-drawing forces less than those of the non-treated samples and at the most comparable to those of samples pre-lubricated by phosphatisation; these results confirm that the hydroxysulphated plates according to the invention present deep-drawing properties at least comparable and in general superior to those of the phosphated plates of the prior art.

EXAMPLE 7

Carrying Out of the Second Method Without Polarisation by Coating: Influence of the Soluble Part of the Deposit on the Pre-lubricating Effect A treatment solution is prepared by dissolution of 25.7 g/l of heptahydrated zinc sulphate in water; the solution is used at its natural pH, without addition of acid nor of base; the natural pH obtained is close to 7.

A homogeneous film of treatment solution is applied by coating of the samples of plates; the solution is applied at ambient temperature.

5 to 60 seconds after application, the sample is dried.

All the deposits obtained on the dried samples then present the same thickness and the same quantity of sulphur.

However, the solubilisable part of the deposit depends on the period (5 to 60 seconds) between the application and the drying, during which the hydroxysulphation reaction was able to develop.

For each sample, the quantity of sulphur corresponding to the solubilisable part of the deposit and that corresponding to the insolubilisable part, i.e. the hydroxysulphate, are measured.

The results obtained are shown in Table V as a function of the drying time.

TABLE V soluble/insoluble part of the deposit obtained by coating

| | Drying time: | 5 s. | 20 s. | 40 s. | 60 s. |
|---|---|---|---|---|---|
| Quantity of S in deposit (mg/m$^2$) | insoluble: | 5 | 6 | 7 | 7 |
| | soluble: | 9 | 8 | 7 | 7 |

It is therefore observed that, at ambient temperature and in the absence of hydroxysulphation accelerator agent, the hydroxysulphation reaction continues up to 40 seconds at the expense of the soluble part of the deposit.

By comparing the results of deep-drawing tests made on samples of which the deposit presents a considerable soluble part, with those of samples where the soluble part was eliminated by rinsing, it is observed that, with identical total quantity of deposited sulphur, the pre-lubricating effect of the non-rinsed deposit is slightly inferior to that of the rinsed deposit, insoluble and principally constituted by hydroxysulphate.

This observation confirms that the pre-lubricating effect is principally contributed by the water-insoluble hydroxysulphate layer.

What is claimed is:

1. A steel plate coated with a metal layer based on zinc, wherein:

said metal layer is itself coated with a layer based on zinc hydroxysulphate, and wherein the surface density of sulphur in said hydroxysulphate layer is more than 0.5 mg/m$^2$.

2. The plate according to claim 1, wherein said layer is water-soluble.

3. The plate according to claim 1, wherein said surface density of sulphur in said hydroxysulphate layer is between 3.5 and 27 mg/m$^2$.

4. The plate according to claim 1, wherein said hydroxysulphate is represented by the general formula:

$$Zn_x(SO_4)_y(OH)_z\ tH_2O,$$

where 2x=2y+z, and y and z different from zero.

5. The plate according to claim 4, wherein z is greater than or equal to 6.

6. The plate according to claim 5, wherein z=6 and $3 \leqq t \leqq 5$.

7. A method for obtaining a plate according to claim 1 from a steel plate coated with a metal layer based on zinc, comprising the following steps:

(A) applying, on the zinc-coated surface of said plate, an aqueous treatment solution containing more than 0.07 moles of sulphate ions per liter, (B) anodically polarizing said surface so as to cause a polarization current to circulate, and (C) rinsing said surface, and then drying the resulting surface, wherein the pH of said treatment solution is greater than or equal to 12, and lower than 13, and wherein during the treatment the quantity of electric charges circulating through said surface and generating on said surface the deposit of a layer comprising sulphur, is adjusted so that the surface density of sulphur in said hydroxysulphate layer is more than 0.5 mg/m$^2$.

8. The method according to claim 7, wherein the concentration of sulphate ions in said treatment solution is less than or equal to 1 mole per liter.

9. The method according to claim 7, wherein said quantity of electric charges circulating is adjusted so that the quantity of hydroxysulphate in said layer is between 3.5 and 27 mg/m$^2$ in sulphur equivalent.

10. The method according to claim 7, wherein the polarization current density applied during the treatment is greater than 20 A/dm$^2$.

11. A method for obtaining a plate according to claim 1 from a steel plate coated with a metal layer based on zinc, comprising the following steps:

(A) applying, on the zinc-coated surface of said plate, an aqueous treatment solution containing more than 0.01 mole of sulphate $SO_4^{=}$ ions per liter, (B) and subsequently drying said aqueous treatment solution, wherein said treatment solution contains $Zn^{2+}$ ions at a concentration greater than 0.01 mole per liter, and wherein the conditions of application are adjusted so that the surface density of sulphur in said hydroxysulphate layer is more than 0.5 $mg/m^2$.

12. The method according to claim 11, further comprising the step of rinsing said plate between said applying step and drying step.

13. The method according to claim 11, wherein the method does not comprise a step of polarization of said zinc-coated surface.

14. The method according to claim 11, wherein, in said treatment solution, the concentration of $Zn^{2+}$ ions is approximately equal to that of the $SO_4^{=}$ ions.

15. The method according to claim 11, wherein the concentration of $Zn^{2+}$ ions and that of the $SO_4^{=}$ ions are between 0.07 and 0.55 mole per liter.

16. The method according to claim 11, wherein the pH of the treatment solution is between 5 and 7.

17. A method for forming a steel plate coated with a metal layer based on zinc comprising the steps of treating the surface of said coated plate, applying a film of lubricating oil on the resulting treated surface and forming said plate proper, wherein said treating is carried out by the method according to claim 7.

18. A method for forming a steel plate coated with a metal layer based on zinc comprising the steps of treating the surface of said coated plate, applying a film of lubricating oil on the resulting treated surface and forming said plate proper, wherein said treating is carried out by the method according to claim 11.

* * * * *